United States Patent [19]

Hutchison et al.

[11] 3,960,014

[45] June 1, 1976

[54] METHOD OF OBTAINING PERMEABILITY INFORMATION FROM AN UNDERGROUND FORMATION PENETRATED BY A WELL

[75] Inventors: Stanley O. Hutchison, Bakersfield; Glenn W. Anderson, Oildale, both of Calif.

[73] Assignee: Chevron Research Company, San Francisco, Calif.

[22] Filed: Dec. 20, 1974

[21] Appl. No.: 534,954

[52] U.S. Cl. ..... 73/151

[51] Int. Cl.[2] ..... E21B 49/00

[58] Field of Search ..... 73/151, 104; 166/133, 166/179

[56] References Cited

UNITED STATES PATENTS

| | | | |
|---|---|---|---|
| 2,416,441 | 2/1947 | Grant et al. | 73/151 |
| 3,046,601 | 7/1962 | Hubbert et al. | 73/151 X |
| 3,049,752 | 8/1962 | Jorda et al. | 73/151 X |

*Primary Examiner*—Jerry W. Myracle

*Attorney, Agent, or Firm*—R. L. Freeland, Jr.; Edward J. Keeling

[57] ABSTRACT

A method of using an impression element in a tubular member positioned in a well and having a flow opening located under liquid to obtain information on the effective connection to permeability of the flow opening with the formation penetrated by the well.

7 Claims, 11 Drawing Figures

12
16
14
20
11
27
15
5
17
5

15
17

19
7
21
7

19
21

12
14
11
20
28
27

12
14
11
28
20
27

METHOD OF OBTAINING PERMEABILITY INFORMATION FROM AN UNDERGROUND FORMATION PENETRATED BY A WELL

RELATED APPLICATIONS

This application is related to the following applications: Ser. No. 367,602, filed June 4, 1973; Ser. No. 373,341, filed June 25, 1973 now U.S. Pat. No. 3,855,854; Ser. No. 373,342, filed June 25, 1973 now U.S. Pat. No. 3,855,855; Ser. No. 373,343, filed June 25, 1973 now U.S. Pat. No. 3,855,856; Ser. No. 423,593, filed Dec. 10, 1973 now U.S. Pat. No. 3,923,312; Ser. No. 430,326, filed Jan. 2, 1974; Ser. No. 510,260, filed Sept. 30, 1974; Ser. No. 510,264, filed Sept. 30, 1974 and Ser. No. 510,265, filed Sept. 30, 1974 now U.S. Pat. No. 3,918,520. The content of these applications is hereby incorporated herein by reference.

BACKGROUND OF THE INVENTION

This invention relates to a method of using an impression element in a well to determine the effective connection to permeability of a fluid flow opening in a tubular member positioned under liquid in the well. More particularly this invention relates to using an inflatable impression packer having an inflatable sleeve containing an impression element to contact a liquid filled tubular member adjacent a fluid flow opening therein to determine whether or not the fluid flow opening is connected for effective fluid flow to or from the formation penetrated by the well.

In well operations and in particular oil well operations it is common practice to place a tubular member such as a well liner or casing in the well adjacent a producing formation. The tubular member is provided with relatively small fluid flow openings which are designed to permit flow of fluids from the formation into the well or from the well into the formation without permitting said or other fines to enter the well. The flow openings in the tubular member may be slots precut in the tubular member before it is positioned in the well or the flow openings may be perforations made in a tubular member after it has been run in the well. The tubular member is usually cemented into place in the well adjacent a desired formation. It is often necessary to know if the flow opening, for example, a slot or a perforation, even though actually existing in the tubular member actually permits flow of fluids to or from the formation. Stated simply, is the flow opening effectively connected to formation permeability? Thus, even though a flow opening may appear to exist in the tubular member effective connection to the formation may be prevented by cement, formation damage or ineffective gun or jet perforation. The present invention is directed to determining whether or not the flow opening is connected to permeability. Further, the present invention is directed to determining the relative permeability to liquid flow through the formation behind the flow opening.

BRIEF DESCRIPTION OF THE PRESENT INVENTION

The present invention provides a method of determining when a fluid flow opening in a tubular member positioned under liquid in a well adjacent an underground formation is connected to permeability outside of the tubular member. An impression element is inserted in the well adjacent a fluid flow opening in a tubular member positioned therein under liquid. The impression element is capable of being at least partially extruded into the opening if the opening is connected to permeability. The tubular member is contacted over the flow opening with the impression element for a period of time and at a pressure normally sufficient to extrude at least a portion of the element into the opening if the opening is connected to permeability outside of the tubular member. The element is removed from the well and examined for an extrusion indicating that the opening is connected to permeability outside the tubular member.

A desirable embodiment of components useful in the practice of the invention include an inflatable impression packer having an inflatable sleeve containing an impression element on at least a portion of its outer surface. The inflatable packer having the inflatable sleeve containing an impression element on at least a portion of its outer surface is lowered into the well and positioned with the impression element adjacent a fluid flow opening in a tubular member which is positioned under liquid adjacent a formation penetrated by the well. The inflatable sleeve is inflated to contact the tubular member over the flow opening with the impression element at a pressure and for a time normally sufficient to cause the impression element to be at least partially extruded into the opening if the opening is connected to permeability outside the tubular member. The sleeve is deflated to remove the impression element from contact with the tubular member. The inflatable packer is withdrawn from the well and the impression element is examined for an extrusion indicating that the opening is connected to permeability outside the tubular member.

In accordance with the invention a qualitative estimation of relative permeability of an underground formation is obtained by comparing extrusions obtained from a well with a series of calibrated extrusion data. The calibrated data for extrusion height vs. core permeability is obtained under conditions and with apparatus equivalent to those expected to be encountered and run in the well of interest. The height of the extrusion of the impressionable material for each core is measured and plotted against permeability of each core. An equivalent inflatable impression packer is then run in the well and operated at substantially the same conditions as those under which the calibrated data were obtained. By comparing the extrusions obtained from the well with the calibrated data qualitative information regarding the relative permeability of the downhole formation is obtained.

OBJECTS OF THE INVENTION

The principal object of the present invention is to provide a well operator with information concerning the effective connection to permeability of a flow opening in a tubular member positioned in a well adjacent an underground formation. Another object of this invention is to provide a well operator with an approximate indication of the relative permeability of a formation penetrated by a well. Further objects and advantages of the present invention will become apparent from the following detailed description read in light of the accompanying drawings which are made a part of this specification.

DETAILED DESCRIPTION OF THE INVENTION

Figures 1, 2, 3, 4, 5, 6, 7:
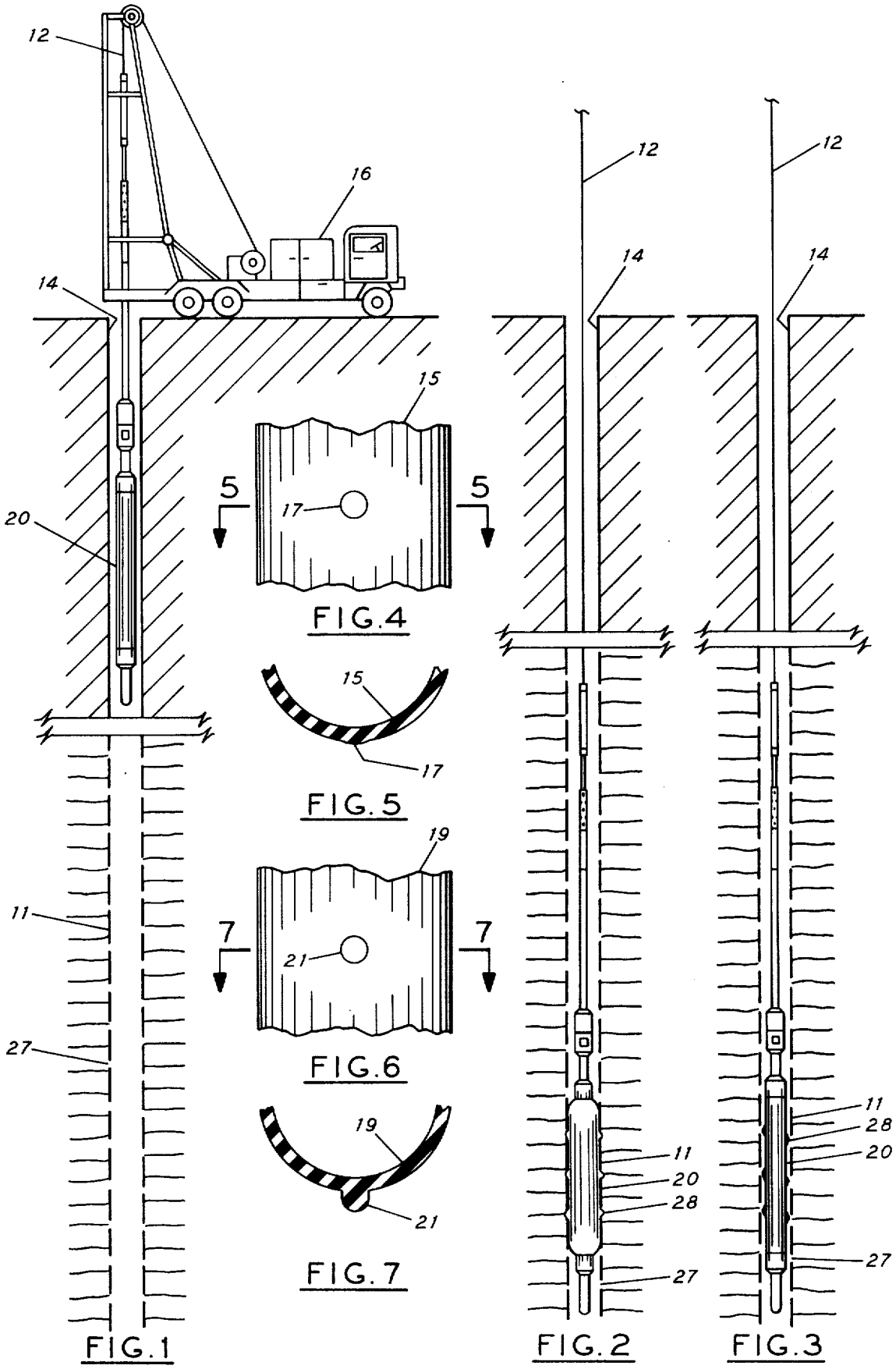
FIG. 1 through FIG. 3 inclusive are elevation views, partially in section, illustrating one form of apparatus being run on wire line through a series of sequential operations performed in a well to obtain an impression record therefrom in accordance with the present invention.
FIG. 4 is an elevation view of a portion of an impression element showing an impression of a flow opening which is not effectively connected to permeability.
FIG. 5 is a sectional view taken at line 5—5 of FIG. 4.
FIG. 6 is an elevation view of a portion of an impression element showing an impression of a flow opening which is effectively connected to permeability.
FIG. 7 is a sectional view taken at line 7—7 of FIG. 6.

FIGS. 1 through 3 illustrate an inflatable packer having an inflatable sleeve containing an impression element during an operational sequence in a well utilizing the impression sleeve to obtain information from the well. The apparatus shown in FIGS. 1–3 is a wire line inflatable packer. It is readily apparent, however, that other modes of apparatus may be utilized to contact the impression element with the tubular member positioned in the well. FIG. 1 shows the wire line inflatable impression packer, illustrated generally by the number 20, hung on wire line 12 in a well 14. A suitable hoist truck 16 is used to run the packer 20 in and out of the well. The inflatable impression packer 20 includes an inflatable sleeve portion and a control portion for inflating and deflating the sleeve.

The wire line inflatable packer 20 is lowered into the well on wire line to a position such as is shown in FIG. 2 from where it is desired to obtain an impression from the well wall. Prior to lowering the wire line inflatable packer 20 into the well a sequencing timer actuating means contained within the control portion of the inflatable packer 20 is activated to begin an automatic sequence of inflation and deflation of the inflatable sleeve of the packer. Thus after elapse of a predetermined time which is of sufficient duration to permit positioning the wire line inflatable impression packer at the desired depth in the well the timer actuating means initiates operation of the inflatable sleeve of the packer and, as shown in FIG. 2, causes it to inflate and press the impression element against a tubular member 11. The impression element on the outside of the inflatable sleeve of the packer is pressed into flow openings 27 which may be slots or perforations to form lasting extrusions 28 on the impression element. From the extrusions on such an element information regarding the effective connection of the flow openings to permeability can be obtained. After a predetermined time has passed the sequencing timer actuation means operates the valve means of the packer to deflate the inflatable sleeve and to remove the impression element from the tubular member as indicated in FIG. 3. The inflatable wire line packer 20 is then returned to the surface by the wire line 12. The extrusions on the impression element are inspected to give information concerning the permeability of the formation behind flow openings in the tubular member 11.

FIG. 4 and FIG. 5 illustrate an impression element 15 which has contacted under liquid a tubular member over a flow opening which is not connected to effective permeability. The impression element 15 was forced against the flow opening for a time and at a pressure which would normally cause the impression material to at least partially extrude into the opening if it was connected to effective permeability. However, there is only an outline 17 of the flow opening which in this case is a perforation indicating that there the flow opening is not connected to permeability.

FIG. 6 and FIG. 7 illustrate an impression element 19 which has contacted under liquid a tubular member over a flow opening which is connected to effective permeability. The impression element 19 was forced against the flow opening for a time and at a pressure which would normally cause the impression material to at least partially extrude into the opening if it was connected to effective permeability. There is an extrusion 21 of the impression material which flowed into the flow opening which in this case is a perforation indicating that there the flow opening is connected to permeability.

Thus in accordance with the invention a method is provided to determine if an opening in a tubular member positioned under liquid in a well adjacent an underground formation is connected to permeability. An impression forming material capable of being at least partially extruded into a flow opening in a well tubular member is inserted into the well adjacent the opening in the tubular member positioned under liquid adjacent an underground formation. The tubular member is contacted with the impression forming material adjacent the flow opening for a period of time and at a pressure normally sufficient to extrude at least a portion of the material into the opening if the opening is connected to permeability. The impression forming material is removed from contact with the tubular member and is then removed from the well. The impression forming material is examined for extrusions to determine if the flow opening is connected to permeability.

In one aspect the invention provides a method of determining when a fluid flow opening in a tubular member positioned under liquid in a well adjacent an underground formation is connected to permeability outside the tubular member utilizing an inflatable impression packer. The inflatable impression packer has an inflatable sleeve containing an impression element on at least a portion of the outer surface of the inflatable sleeve. The packer is run into a well adjacent a fluid flow opening in a tubular member positioned adjacent a formation penetrated by the well. The inflatable sleeve is inflated to cause the impression element to contact the tubular member over the flow opening at a pressure and for a time normally sufficient to cause the impression element to be at least partially extruded into the flow opening if the opening is connected to permeability outside the tubular member. The inflatable sleeve is deflated to remove the impression element from contact with the tubular member and the packer is withdrawn from the well. The impression element is examined for an extrusion indicating that the opening is connected to permeability outside the tubular member.

In accordance with another aspect of the invention an approximation of relative permeability of an underground formation is obtained by comparing extrusions taken in a well with calibrated extrusion data developed on the surface. The data includes extrusion height vs. core permeability obtained under conditions similar to those encountered in the well of interest. An equivalent inflatable impression packer is run in surface apparatus under simulated well conditions and well geometry. A series of cores of different permeability are placed in the surface apparatus and an impression run of the same time and pressure as will be used downhole is done on each core. The height of the extrusion of the impression material for each core is measured and plotted against permeability of each core. A similar inflatable impression packer is then run in the well and operated at the same conditions as was the inflatable impression packer used in the surface apparatus. By comparing the extrusions obtained from the well with the calibrated data obtained from the surface apparatus runs qualitative information regarding the relative permeability of the downhole formation is obtained.

There are a number of suitable materials from which impression elements may be made. The impression element is often formed in a sheet and connected in a sleevelike manner to an inflatable sleeve of an inflatable packer. The impression sleeve is formed of a material which will expand and retract so that an impression may be extruded and then the packer may be removed from the well so the impression may be examined. The material used to form the impression element or sleeve must be smooth so that impression detail will be readily observable on the sleeve after a run of the impression packer. That is, the surface of the impression sleeve must not be so rough that detail of the impression is lost. Generally, a surface which feels smooth to the hand and visually appears to have no major roughness, is required.

One material especially useful as an impression sleeve of an expandable and retractable packer which sleeve will form and retain an impression of irregularities in a downhole surface and will extrude into a flow opening is formed of a mixture of partially cured synthetic nitrile rubber, natural rubber smoked sheet, hydrated amorphous silica powder and rubber processing oil. The partial cure of the synthetic nitrile rubber is done by heating nitrile rubber containing less than full curing amounts of sulfur, stearic acid and zinc oxide, the curing chemicals. Broadly, a mixture containing from about 60% to 80% by weight of partially cured synthetic nitrile rubber including the cure chemicals, from about 10% to 20% natural rubber smoked sheet, from about 5% to 15% by weight of hydrated amorphous silica powder, and from about 2% to 6% by weight of rubber processing oil has been found satisfactory. A particularly desirable impression sleeve (indicated as A in FIGS. 8–10) has resulted when the mixture comprises from about 70% to 75% by weight of partially cured synthetic nitrile rubber including the cure chemicals, from 14% to 16% by weight of natural rubber smoked sheet, about 7.5% to 8.5% by weight silica powder, and about 3.5% to 4.5% by weight rubber processing oil.

Another material useful as an impression sleeve of an expandable and retractable packer which sleeve will form and retain an impression of irregularities in a downhole surface and will extrude into a flow opening is formed of a mixture of synthetic nitrile rubber, natural rubber smoked sheet, hydrated amorphous silica powder and rubber processing oil. A mixture containing from about 60% to 80% by weight of synthetic nitrile rubber; from about 10% to 20% natural rubber smoked sheet; from about 5% to 15% by weight of hydrated amorphous silica powder; and from about 2% to 6% by weight of rubber processing oil has been found satisfactory. A particularly desirable impression sleeve (indicated as B in FIGS. 8–10) has resulted when the mixture comprises from about 70% to 75% by weight of synthetic nitrile rubber; from 14% to 16% by weight of natural rubber smoked sheet; about 7% to 8% by weight silica powder; and about 3% to 4% by weight rubber processing oil.

Still another material useful as an impression sleeve of an expandable and retractable packer which sleeve will form and retain an impression of irregularities in a downhole surface and will extrude into a flow opening is formed of a mixture of natural rubber smoked sheet, hydrated amorphous silica powder and rubber processing oil. A mixture containing from about 50% to 75% by weight of natural rubber smoked sheet; from about 10% to 30% by weight of hydrated amorphous silica powder; and from about 3% to 15% by weight of rubber processing oil has been found satisfactory. A particularly desirable impression sleeve (indicated as C in FIGS. 8–10) has resulted when the mixture comprises about 57.2% by weight of natural rubber smoked sheet; about 28.4% silica powder; and about 14.4% rubber processing oil.

In actual field operations an impression sleeve element was run into a well on an inflatable packer to check a new jet perforation job. The inflatable impression packer was run into the newly jet perforated well and activated. However, no extrusions were generated on the impression element. The packer was rerun at a higher inflation pressure with the same negative results. The questions was then raised as to whether or not impressionable material could be extruded into a perforation which was filled with a noncompressible liquid and not connected to permeability. Additional field activity supported the concept that no extrusion of the impression material into a flow opening will occur when the flow opening is not connected to permeability. The well discussed above was reperforated with a more powerful deep penetrating jet. A subsequent run of the inflatable impression packer at the original pressure exhibited a series of extrusions of good height indicating a uniform pattern of perforations which extended to permeability.

In a further field demonstration another well was jet perforated and inflatable impression packer runs over several intervals indicated that the jet perforation operation was not entirely successful. Thus impression packer runs were initially made over four intervals and the resulting examination of the extrusions indicated the following results: Top interval - 77% of the perforations opened to permeability; second interval - 43% of the perforations opened to permeability; third interval - 3% of the perforations opened to permeability, and lower interval - 15% of the perforations opened to permeability. A push out wash job with acid was then done in the well. Subsequent inflatable impression packer runs were made over the same four intervals and the examination of the extrusions indicated the following results: Top interval - 98% of the perforations opened to permeability; second interval - 90% of the perforations opened to permeability; third interval - 67% of the perforations opened to permeability and lower interval - 82% of the perforations opened to permeability. Steam injection into the intervals after the acid wash at low pressures and the producibility of the well after steaming were further proof of the effectiveness of the perforations and showed that the perforations were connected to permeability outside the casing.

To further demonstrate that permeability information can be obtained with the inflatable impression packer, certain demonstrations were conducted. A horizontal section of 7 inch casing was fabricated with 4¾ inch pipe collars welded over ¼ inch, ⅜ inch, ½ inch and ⅝ inch holes drilled through the pipe. The collars were threaded for receiving plugs or pressure gauges and positioned on the bottom side of the pipe. The holes or flow openings in the casing could thus be plugged or fitted with a pressure gauge. Dam-plates were welded on each end of the casing so that the bottom ⅓ of the casing could be filled with water. A short inflatable impression packer was inserted into the pipe and inflated for a prescribed time sufficient to normally extrude the impression material into the hole. The packer was then deflated. Inspection of the packer after deflation indicated only slight impression marks from the sharp edged drilled holes but no extrusions in the plugged collars. During subsequent tests a very slight thread leak developed in one of the plugged collars and extrusion occurred indicating that the extrusion of impressionable material into a flow opening was very sensitive to whether the hole was connected to permeability. These demonstrations indicated that the inflatable impression packer could be used to determine whether or not perforations in wells were connected to permeability. Thus the effectiveness of a perforation could be determined for if the fluid in the perforation could not be displaced by the very low differential extrusion pressures developed by the inflatable impression packer then conversely formation fluids could not enter the well bore through these perforations at the very low formation pressure which exist in the most low gravity semi-depleted reservoirs. The data developed in these demonstrations are given below. All the demonstrations were conducted at a temperature of about 85°F.

DEMONSTRATION I

| Hole Size | Inflation Pressure | Inflation Time | Core Holder Outlet | Gauge Pressure | Extrusion Height |
|---|---|---|---|---|---|
| 1/4" | 100 psi | 10 min. | Pressure Gauge | 5 psi | 1/4" |
| 3/8" | 100 psi | 10 min. | Plugged | — | None (Mark) |
| 1/2" | 100 psi | 10 min. | Plugged | — | None (Mark) |
| 5/8" | 100 psi | 10 min. | Pressure Gauge | 22 psi | 5/16" |

DEMONSTRATION II

| Hole Size | Inflation Pressure | Inflation Time | Core Holder Outlet | Gauge Pressure | Extrusion Height |
|---|---|---|---|---|---|
| 1/4" | 150 psi | 10 min. | Pressure Gauge | 5 psi | 1/4" |
| 3/8" | 150 psi | 10 min. | Plugged | — | Slight |
| 1/2" | 150 psi | 10 min. | Plugged | — | None |
| 5/8" | 150 psi | 10 min. | Pressure Gauge | 123 psi | 3/8" |

DEMONSTRATION III

| Hole Size | Inflation Pressure | Inflation Time | Core Holder Outlet | Gauge Pressure | Extrusion Height |
|---|---|---|---|---|---|
| 1/4" | 100 psi | 5 min. | Press. Gauge | 5 psi | 5/16" |
| | then 200 psi | 5 min. | Press. Gauge | 5 psi | |
| | | Total 10 min. | | | |
| 3/8" | 100 psi | 5 min. | Press. Gauge | 13 psi | 5/16" |
| | then 200 psi | 5 min. | Press. Gauge | 16 psi | |
| | | Total 10 min. | | | |
| 1/2" | 100 psi | 5 min. | Press. Gauge | 70 psi | On seam of packer |
| | then 200 psi | 5 min. | Press. Gauge | 168 psi | extrusion distorted |
| | | Total 10 min. | | | |
| 5/8" | 100 psi | 5 min. | Plugged | — | None |
| | then 200 psi | 5 min. | Plugged | — | |
| | | Total 10 min. | | | |

DEMONSTRATION IV

Inflated packer to contact with casing. 25 psi inflation pressure. All collars plugged. Filled plugged collars with grease - squeezing with plugs several times to get air out. Tightened plugs. Inflated to 150 psi for 10 minutes.

| | | |
|---|---|---|
| Results: | 1/4" - no extrusion | |
| | 3/8" – 1/4" extrusion - | no grease at packer - collar not full of grease |
| | 1/2" - no extrusion | |
| | 5/8" - no extrusion | |

To further demonstrate the invention laboratory demonstrations were devised to compare extrusion height with the known air permeability of formation cores. The apparatus consisted of a horizontal tubular member with 3-core holders hanging down vertically. FIG. 11 schematically illustrates one such core holder arrangement. The sealed core holders were connected to the tubular member through a ⅜ inch diameter by 1 inch long neck. The procedure consisted of mounting a set of three cores of known permeability in the mounts on the tubular member and then carefully filling the connecting necks with 90 wt. gear oil. Then a small inflatable packer covered with impressionable material was inflated in the tubular member for a prescribed time, deflated, removed and extrusion heights measured. The results of these demonstrations run at various inflation pressures, temperatures and using different impression materials indicated that extrusion height is proportional to permeability. The data developed in these demonstrations are set out in FIGS. 8, 9 and 10.

Figure 8:
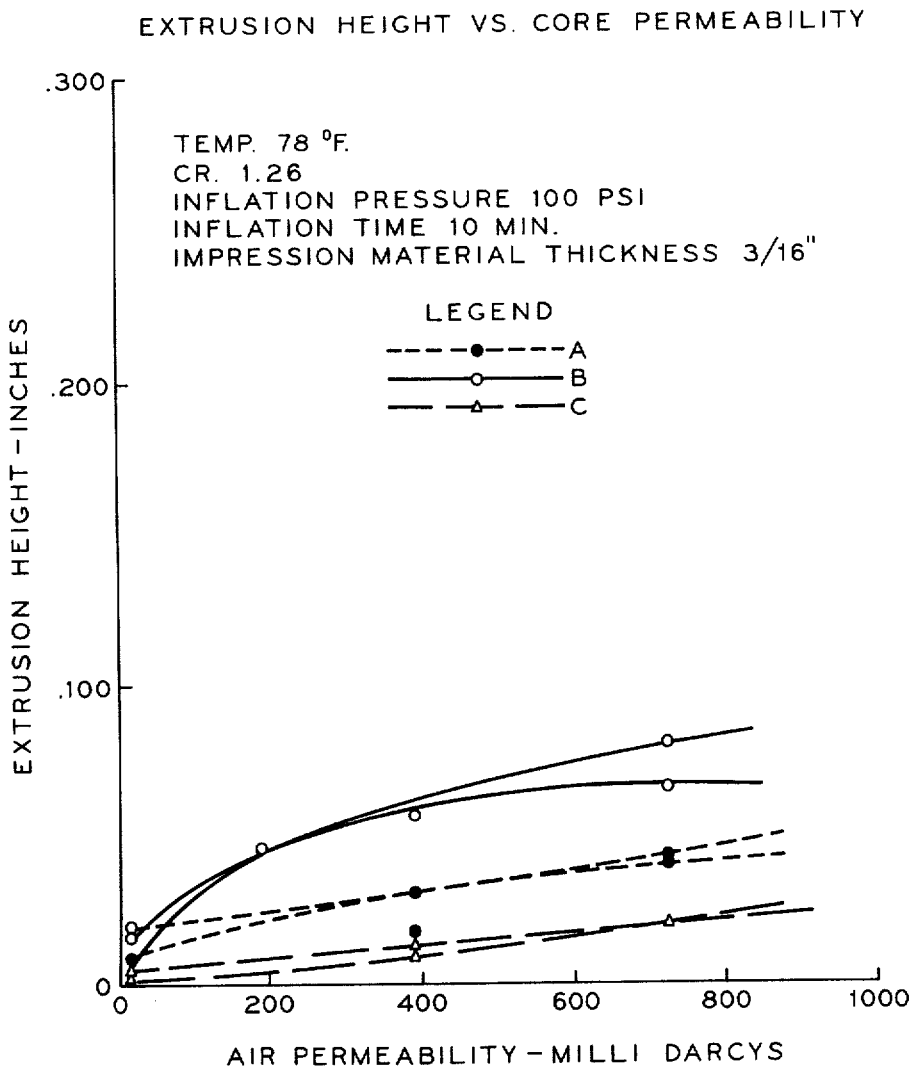
FIG. 8 is a curve of extrusion height of an impression vs. permeability of a core behind a flow opening for three impression materials at 78°F.

FIG. 8 is a graph of extrusion height in inches of the impressionable material vs. air permeability of a core in millidarcies. The runs were made at 78°F with an inflatable impression packer having a circumference ratio of 1.26. The circumference ratio is calculated by dividing the circumference of the deflated impression packer into the interior circumference of the casing in which the impression packer is run. The inflation pressure was 100 lbs. per square inch and the inflation time was 10 minutes. The impression material thickness for all three materials was 3/16 of an inch. It is noted that with one exception as the permeability approached zero the extrusion height also approached zero. It is also apparent that as core permeability increases the extrusion height also increases.

Figure 9:
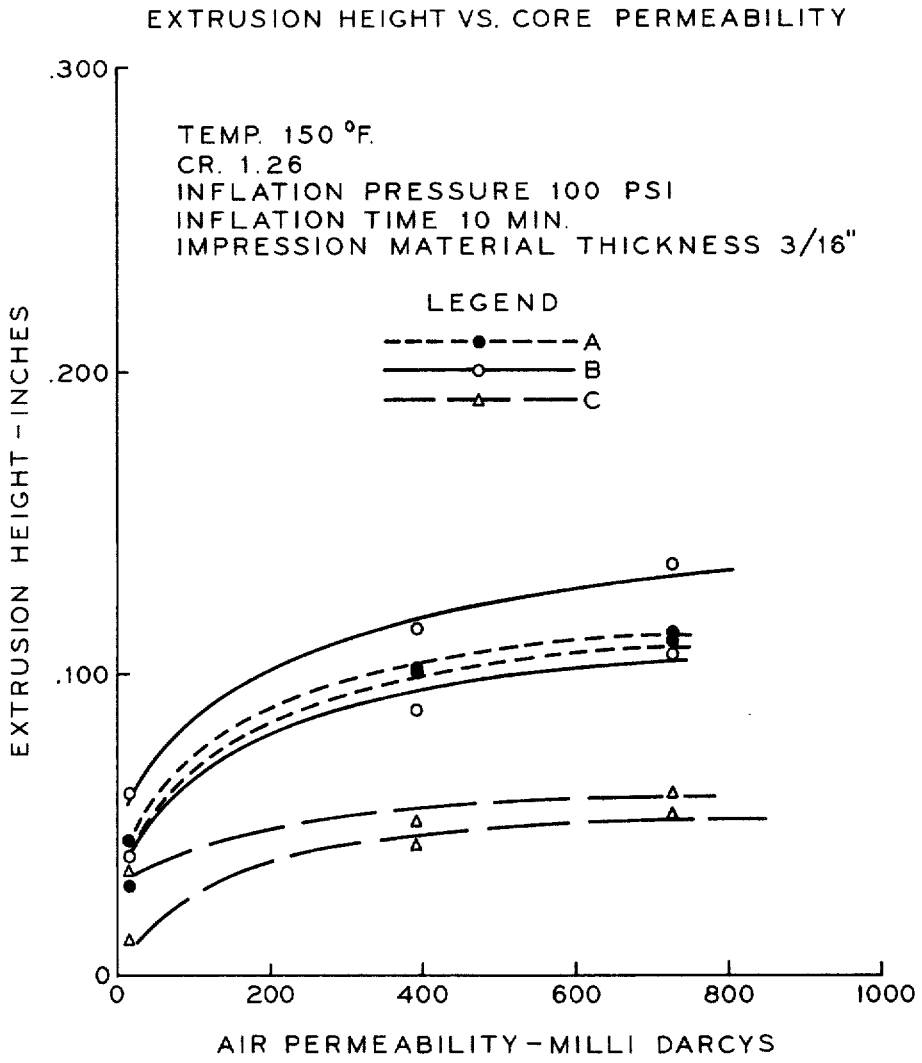
FIG. 9 is a curve of extrusion height of an impression vs. permeability of a core behind a flow opening for three impression materials at 150°F.

FIG. 9 is also a plot of extrusion height vs. air permeability of a core in millidarcies and, as shown, the extrusion height is proportional to the air permeability of the core in millidarcies. Thus the greater the permeability the longer the extrusion. The data of FIG. 9 were taken at 150°F. The circumference ratio was equal to 1.26. The inflation pressure was 100 psi and the inflation time was 10 minutes. The impression material thickness was 3/16th of an inch in all cases.

Figure 10:
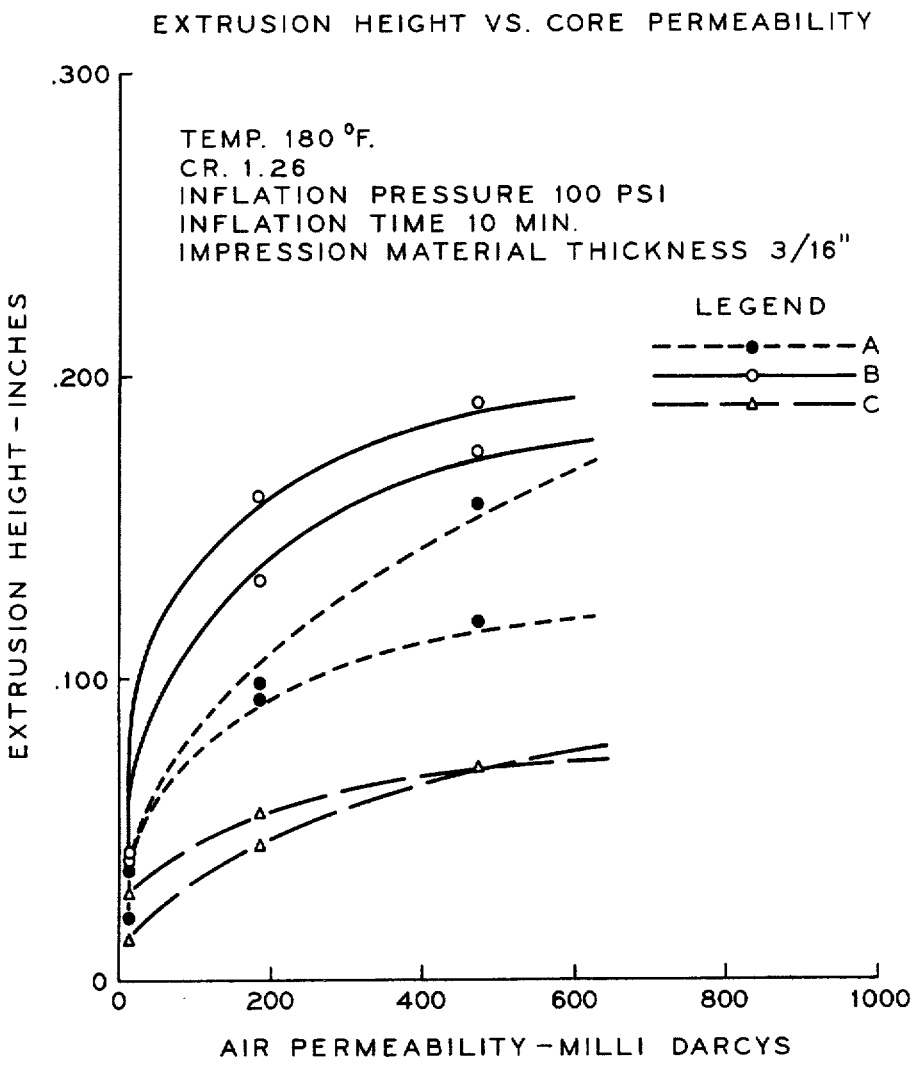
FIG. 10 is a curve of extrusion height of an impression vs. permeability of a core behind a flow opening for three impression materials at 180°F.
Figure 11:
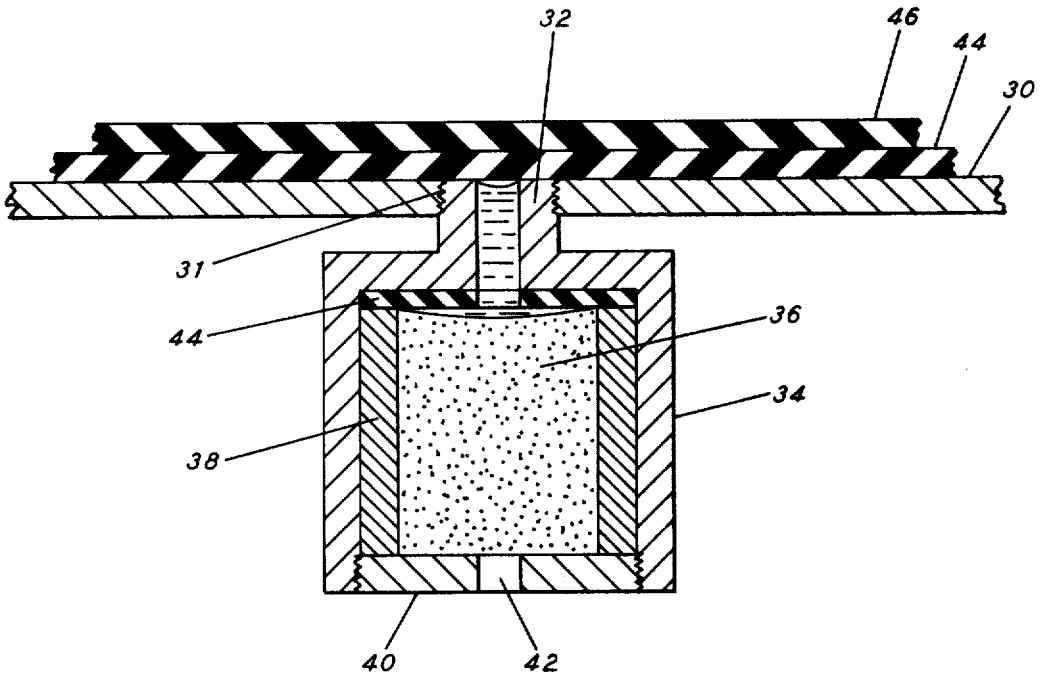
FIG. 11 is a sectional schematic view of a test apparatus useful to obtain permeability data in accordance with the invention.

FIG. 10 illustrates extrusion height vs. core permeability at 180°F. Again, evidence is shown that extrusion height is proportional to core permeability and, further, that where the flow opening is not connected to permeability zero extrusion height results. The data shown in FIG. 10 were also obtained using a circumference ratio of 1.26, an inflation pressure of 100 psi, an inflation time of 10 minutes and a material thickness of 3/16 inch.

FIG. 11 is a schematic sectional view of apparatus useful in attaining the data illustrated in FIGS. 8, 9 and 10. As shown in FIG. 11 a tubular member 30 is provided with a threaded opening 31. The neck 32 of a core holder 34 is screwed into the hole 31 provided in the wall of the tubular member 30. The core holder 34 is adapted to receive a core 36 which is bonded in an aluminum sleeve 38 by a suitable epoxy. A butt plate 40 having a flow opening 42 is used to force the core against a suitable gasket 44. The gasket and the neck of the core holder are provided with a central flow opening. This flow opening is filled with a suitable liquid and the core is saturated with a similar liquid. An impression element 44 backed by an inflatable sleeve 46 is positioned against the inner wall of the tubular member 30. Pressure is exerted on the impression sleeve 44 by the inflatable sleeve 46 and, provided the core has permeability, the impression material is extruded into the central opening of the core holder neck 32. As indicated, the height of the extrusion, other conditions being held the same, is proportional to the permeability of core 36.

A qualitative estimation of relative permeability of the underground formation is obtained by first obtaining a series of calibrated data utilizing apparatus such as is shown in FIG. 11. The data for extrusion height vs. core permeability is obtained under conditions similar to those expected to be encountered in the well of interest. Thus the tubular member of the FIG. 11 apparatus is sized identical to the tubular member located in the well. An inflatable impression packer is run in the FIG. 11 apparatus and sized to be substantially similar to the inflatable impression packer which is run in the well. The temperature of the FIG. 11 apparatus is maintained at the equivalent of downhole temperature. The tubular member and the cores are filled with equivalent well liquid. A series of cores of different permeability are placed in the core holder and an impression run of the same time and pressure as will be used downhole is done on each core. The height of the extrusion of the impressionable material for each core is measured and plotted against permeability of each core. In this manner a graph similar to FIGS. 8–10 is compiled. An identical inflatable impression packer is then run in the well and operated at the same conditions that the FIG. 11 inflatable impression packer was operated. By comparing the extrusions obtained from the well with the calibrated data obtained from the FIG. 11 apparatus qualitative information regarding the relative permeability of the downhole formation is obtained.

It will be readily appreciated from the foregoing disclosure and demonstrations that variations can be made by those skilled in the art without departing from the scope and spirit of the appended claims.

What is claimed is:

1. A method of obtaining permeability information from an underground formation penetrated by a well having a tubular member with at least one flow opening therein and positioned under liquid in said well adjacent said formation comprising the steps of inserting into a well adjacent an opening in a tubular member positioned under liquid adjacent an underground formation an extrudable rubber like impression forming material, said impression forming material being capable of being at least partially extruded into said opening and retracted therefrom, contacting said tubular member adjacent said opening with said material for a period of time and at a pressure normally sufficient to extrude at least a portion of said material into said opening if said opening is connected to permeability, removing said material from contact with said tubular member, removing said material from said well and examining said material for extrusions to determine if said opening in said tubular member is effectively connected to permeability.

2. A method of obtaining permeability information from an underground formation penetrated by a well having a tubular member with at least one flow opening therein and positioned under liquid in said well adjacent said formation comprising the steps of inserting into a well adjacent an opening in a tubular member positioned under liquid adjacent an underground formation an extrudable rubber like impression forming material, said impression forming material being capable of being at least partially extruded into said opening and retracted therefrom, contacting said tubular member adjacent said opening with said material for a period of time and at a pressure normally sufficient to extrude at least a portion of said material into said opening if said opening is connected to permeability, removing said material from contact with said tubular member, removing said material from said well and examining said material for extrusions to determine if said opening is connected to permeability outside said tubular member.

3. A method of obtaining permeability information from an underground formation penetrated by a well having a tubular member with at least one flow opening therein and positioned under liquid in said well adjacent said formation comprising the steps of obtaining calibrated data of extrusion height versus core permeability with a calibrated inflation impression packer operated under known conditions, inserting into a well adjacent an opening in a tubular member position under liquid adjacent an underground formation an extrudable rubber like impression forming material, said impression forming material being capable of being at least partially extruded into said opening and retracted therefrom, contacting said tubular member adjacent said opening with said material for a period of time and at a pressure normally sufficient to extrude at least a portion of said material into said opening if said opening is connected to permeability, removing said material from contact with said tubular member, removing said material from said well, examining said material for extrusions and comparing said extrusions with surface obtained calibrated data of extrusion height vs. core permeability to obtain information on the relative permeability of said formation.

4. A method of determining if an opening in a tubular member positioned under liquid in a well adjacent an underground formation is connected to permeability comprising the steps of inserting into a well adjacent an opening in a tubular member positioned under liquid adjacent an underground formation an extrudable rubber like impression forming material, said impression forming material being capable of being at least partially extruded into said opening and retracted therefrom, contacting said tubular member adjacent said opening with said material for a period of time and at a pressure normally sufficient to extrude at least a portion of said material into said opening if said opening is connected to permeability, removing said material from contact with said tubular member, removing said material from said well and examining said material for extrusions to determine if said opening is connected to permeability.

5. A method of obtaining permeability information from an underground formation penetrated by a well containing a tubular member having a flow opening located under liquid therein comprising lowering an inflatable packer having an inflatable sleeve containing an extrudable rubber like impression element on at least a portion of the outer surface of said inflatable sleeve into a well adjacent a fluid flow opening in a tubular member positioned adjacent a formation penetrated by said well, inflating said inflatable sleeve to contact said tubular member over said opening with said impression element at a pressure and for a time normally sufficient to cause said impression element to be at least partially extruded into said opening if said opening is connected to permeability outside said tubular member and withdrawing said inflatable packer from said well to examine said impression element for extrusions to determine if said opening in said tubular member is effectively connected to permeability.

6. A method of determining when a fluid flow opening in a tubular member positioned under liquid in a well adjacent an underground formation is connected to permeability outside the tubular member comprising lowering an inflatable packer having an inflatable sleeve containing an extrudable rubber like impression element on at least a portion of the outer surface of said inflatable sleeve into a well adjacent a fluid flow opening in a tubular member positioned adjacent a formation penetrated by said well, inflating said inflatable sleeve to contact said tubular member over said opening with said impression element at a pressure and for a time normally sufficient to cause said impression element to be at least partially extruded into said opening if said opening is connected to permeability outside said tubular member, deflating said inflatable sleeve to remove said impression element from contact with said tubular member and withdrawing said inflatable packer from said well to examine said impression element for extrusions indicating that said opening is connected to permeability outside said tubular member.

7. A method of obtaining an approximation of relative permeability of an underground formation comprising obtaining with a calibration inflatable impression packer operating in a calibration tubular member calibrated data for extrusion height vs. core permeability under conditions similar to those expected to be encountered in a well of interest for cores of varying permeability, running an equivalent inflatable impression packer into the well penetrating an underground formation and having a well tubular member positioned herein, said well tubular member having the same diameter as said calibration tubular member, operating said equivalent inflatable impression packer in said well at the same conditions as said calibration inflatable impression packer to obtain extrusions from said well and comparing the extrusions obtained from said well with said calibrated data to obtain information regarding the approximate relative permeability of the underground formation.

* * * * *